US006371819B1

(12) United States Patent
Ozawa et al.

(10) Patent No.: US 6,371,819 B1
(45) Date of Patent: Apr. 16, 2002

(54) THROTTLE POSITION SENSOR MOUNTING ARRANGEMENT FOR PERSONAL WATERCRAFT ENGINE

(75) Inventors: Sigeyuki Ozawa; Ryoichi Nakase, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/391,927

(22) Filed: Sep. 8, 1999

Related U.S. Application Data

(62) Division of application No. 08/999,282, filed on Dec. 29, 1997, now Pat. No. 5,967,861.

(30) Foreign Application Priority Data

Dec. 28, 1996 (JP) ..... 8-359050

(51) Int. Cl.[7] ..... B63H 21/21
(52) U.S. Cl. ..... 440/1; 123/336; 440/88
(58) Field of Search ..... 440/1, 88, 111, 440/75; 114/55.51, 55.57; 123/336, 337

(56) References Cited

U.S. PATENT DOCUMENTS

| | | | | |
|---|---|---|---|---|
| 4,141,309 A | | 2/1979 | Halboth | |
| 4,984,528 A | * | 1/1991 | Kobayashi | 114/55.51 |
| 5,181,491 A | * | 1/1993 | Izumi et al. | 123/336 |
| 5,445,121 A | | 8/1995 | Kai | |
| 5,553,579 A | | 9/1996 | Yoshida et al. | |
| 5,606,952 A | | 3/1997 | Kanno et al. | |
| 5,655,500 A | * | 8/1997 | Kato | 123/336 |
| 5,704,334 A | | 1/1998 | Kato | |
| 5,902,158 A | * | 5/1999 | Nakase et al. | 440/88 |
| 5,906,524 A | * | 5/1999 | Ozawa et al. | 440/88 |
| 5,967,861 A | * | 10/1999 | Ozawa et al. | 440/1 |

FOREIGN PATENT DOCUMENTS

| | | | | |
|---|---|---|---|---|
| JP | 7-237586 | * | 9/1995 | 440/111 |

OTHER PUBLICATIONS

33 C.F.R. § 183.630, Feb. 4, 1980.

* cited by examiner

*Primary Examiner*—Sherman Basinger
(74) *Attorney, Agent, or Firm*—Knobbe, Martens, Olson & Bear, LLP

(57) ABSTRACT

A mounting arrangement for a throttle position sensor associated with a throttle valve is disclosed. The throttle valve is positioned within an intake pipe of an intake system of an engine which is positioned in an engine compartment defined by a hull of a watercraft. An output shaft of the engine is arranged to drive a water propulsion device of the watercraft. The intake pipe extends from the engine and is arranged to route air to a combustion chamber of the engine. The throttle position sensor is mounted so as to be shielded by the intake pipe from a source of water within the engine compartment, such as an outlet of an intake duct leading through the hull of the watercraft.

36 Claims, 11 Drawing Sheets

THROTTLE POSITION SENSOR MOUNTING ARRANGEMENT FOR PERSONAL WATERCRAFT ENGINE

This application is a divisional application of U.S. application Ser. No. 08/999,282, filed Dec. 29, 1997, now U.S. Pat. No. 5,967,861.

FIELD OF THE INVENTION

The present invention relates to a throttle position sensor, and more particularly to a mounting arrangement for such a sensor used with an engine powering a watercraft.

BACKGROUND OF THE INVENTION

Watercraft such as those known as "personal watercraft" have a hull which defines an engine compartment, and include a water propulsion device. An internal combustion engine is positioned in the engine compartment. An output shaft of the engine is arranged to drive the water propulsion device.

The engine has an intake system which draws air from within the engine compartment and delivers it to the combustion chamber(s) thereof. The watercraft includes one or more air passages leading from a point external to the hull through the hull into the engine compartment.

In addition, the watercraft includes a fuel system for supplying fuel to each combustion chamber of the engine. The fuel system includes a fuel tank positioned in the hull of the watercraft and a fuel pump delivering fuel from the tank to at least one charge former which introduces fuel to the engine.

A throttle control may be provided in the intake system of the engine for controlling the rate of air flow therethrough. In order to accurately control the rate of fuel delivery to the engine, the rate of air flow is measured. This may be accomplished indirectly with a throttle control sensor.

Because the watercraft is operated in the water, water often enters the air passages through the hull. This water may damage sensitive components, such as a throttle position sensor. In addition, water which enters the hull and settles at the lower surface may be thrown about the engine compartment by the spinning output shaft of the engine or by the rocking and pitching movement of the watercraft. This water may also damage sensitive components.

A watercraft arranged to overcome the above-stated problems is desired.

SUMMARY OF THE INVENTION

In accordance with the present invention there is provided a mounting arrangement for a throttle position sensor associated with an internal combustion engine powering a water propulsion device of a watercraft.

The watercraft has a water propulsion device and a hull defining an engine compartment, an internal combustion engine positioned in the engine compartment. The engine has an output shaft arranged to power the water propulsion device.

The engine has an intake system through which air is supplied to each combustion chamber of the engine. The intake system includes an intake pipe. A throttle valve is positioned in a passage through the intake pipe for controlling the rate of air flow therethrough.

The throttle position sensor is provided for monitoring the position of the throttle valve, and is mounted so as to be shielded by the intake pipe from a source of water within the engine compartment. This source of water may comprise an outlet of an air intake duct leading through the hull of the watercraft, or water thrown by the spinning output shaft of the engine.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
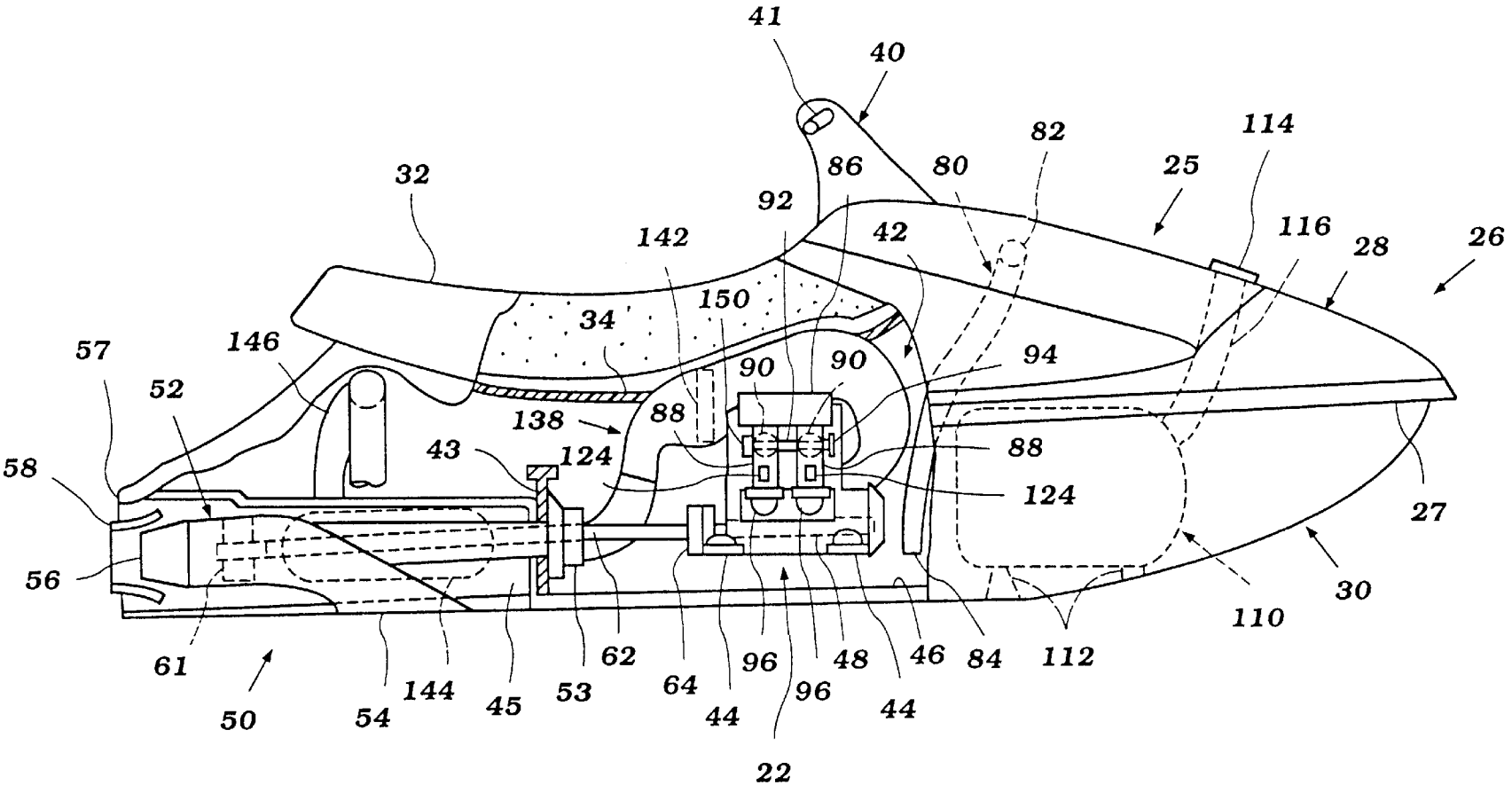
FIG. 1 is a side view of a watercraft powered by an engine and having a throttle position sensor mounted in accordance with a first embodiment of the present invention, the watercraft illustrated partially cut-away to illustrate the engine therein.
Figure 2:
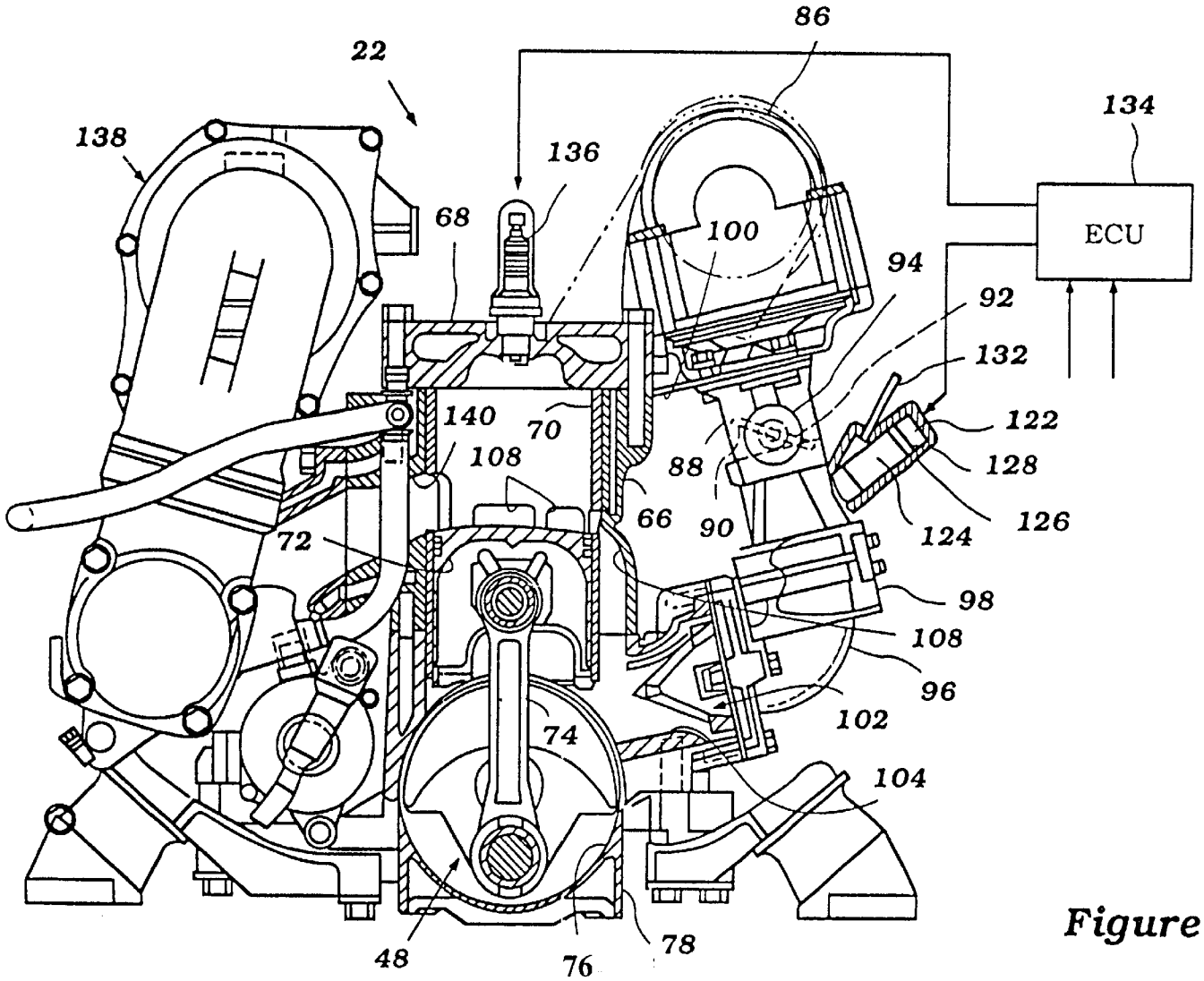
FIG. 2 is a cross-sectional end view of the engine illustrated in FIG. 1.
Figure 3:
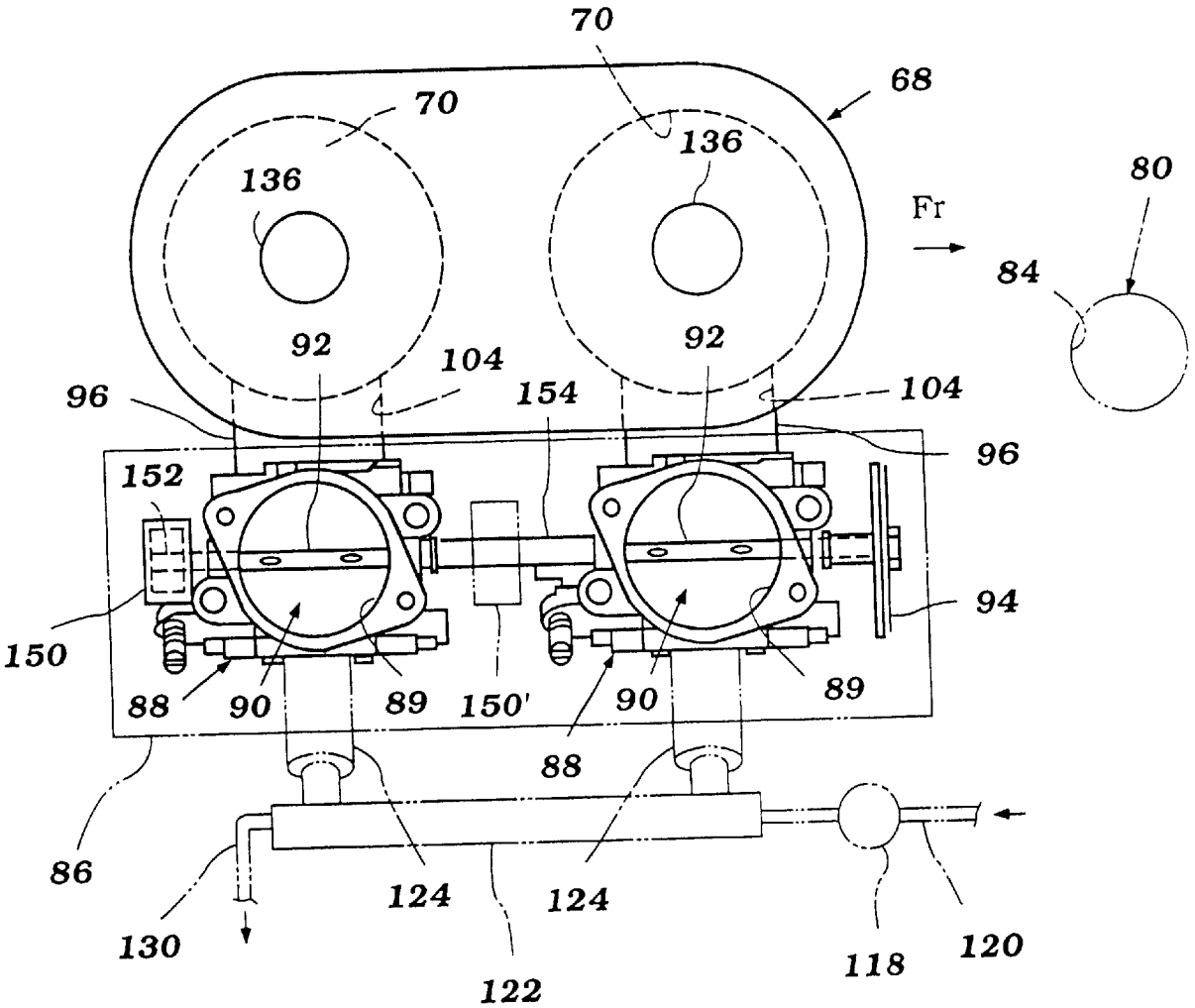
FIG. 3 is a top view of a portion of the engine illustrated in FIG. 1, with an intake silencer illustrated in phantom and an intake duct of the watercraft also illustrated in phantom, and illustrating the throttle position sensor mounted in accordance with the first embodiment of the invention.

FIGS. 1–3 illustrate a watercraft 20 having a mounting arrangement for a throttle position sensor in accordance with a first embodiment of the present invention. Referring first to FIG. 1, the watercraft 20 generally comprises a watercraft body 25 having the engine 22 mounted therein for powering a water propulsion device. The watercraft body 25 preferably comprises a hull 26 having a top portion or deck 28 and a lower portion 30. A gunnel 27 defines the intersection of the deck 28 and lower portion 30.

In addition, the body 25 includes a seat 32 positioned on the top portion 28 of the hull 26. The seat 32 is removably positioned over an access opening 34 which provides access to the engine 22 positioned therebelow. A steering handle 40 is provided adjacent the seat 32 for use by a user in directing the watercraft 20 in a manner described in more detail below. A throttle control grip 41 extends from the steering handle 40, the grip used to control the position of a throttle, as described in more detail below.

The top and bottom portions 28,30 of the hull 26 cooperate with a bulkhead 43 to define an engine compartment 42 and a propulsion compartment 45. The engine 22 is positioned in the engine compartment 42. The engine 22 is connected to the hull 26 via several engine mounts 44 connected to a bottom 46 of the lower portion 30 of the hull 26.

The engine 22 has a crankshaft 48 arranged to drive a water propulsion device 50 of the watercraft 20. The water propulsion device 50 preferably comprises a propulsion passage 52 in which is positioned an impeller 61. The propulsion device 50 is preferably positioned in the propulsion compartment 43.

The propulsion passage 52 has an inlet 54 positioned in the bottom of the hull 26, and an outlet 56 facing a stern 57 of the craft 20. The impeller 61 is positioned in the passage 52 between the inlet 54 and outlet 56 and is driven by an impeller shaft 62. The impeller shaft 62 extends from the impeller through a bearing 53 positioned at the bulkhead 41. The impeller shaft 62 is driven by the crankshaft 48 of the engine 22 through a coupling 64.

A nozzle 58 is movably positioned at the outlet 56 of the passage 52 for directing water which is forced through the outlet. The nozzle 58 is connected to the steering handle 40. In this manner, the operator of the craft 20 may direct the craft in different directions by directing the propelled water with the nozzle 58 by turning the steering handle 40.

The engine 22 is illustrated in FIGS. 1–3. As illustrated therein, the engine 22 is preferably of the two-cylinder variety, arranged in in-line fashion and operating on a two-cycle principle. Of course, the engine 22 may have as few as one, or more than two, cylinders, as may be appreciated by one skilled in the art.

The engine 22 includes a cylinder block 66 having a cylinder head 68 connected thereto and cooperating therewith to define two cylinders 70. A piston 72 is movably mounted in each cylinder 70 and connected to the crankshaft 48 via a connecting rod 74.

The crankshaft 48 is rotatably journalled with respect to the cylinder block 66 within a crankcase chamber 76. Preferably, the chamber 76 is defined by a crankcase cover member 78 which is connected to an end of the cylinder block 66 opposite the cylinder head 68.

In the embodiment illustrated in FIGS. 1–3, the engine 22 is arranged so that the crankshaft 48 extends generally parallel to a longitudinal axis through the watercraft 20 from a front end to the stern 57.

The engine 22 includes means for providing an air and fuel mixture to each cylinder 70 for combustion therein. Referring to FIG. 1, air is drawn in to the engine compartment 42 through an intake duct 80. As illustrated, the inlet 80 extends from an opening 82 in the top portion 28 of the hull 26 downwardly through the engine compartment 42 to an outlet 84 positioned near the bottom 46 of the hull 26. In the embodiment illustrated, the intake duct 80 is positioned in front of the engine 22 towards the front end of the watercraft 20.

Referring now primarily to FIG. 2, air within the engine compartment 42 is drawn through a filtered intake 86. The air passes from the intake 86 into an intake pipe. Preferably, the intake pipe comprises a throttle body 88 and an intake manifold 96 corresponding to each cylinder 70. Thus, in the illustrated embodiment, there are two throttle bodies 88 spaced from one another in a longitudinal direction along the length of the watercraft (see FIG. 1). A throttle valve 90 is movably positioned in a passage 89 (see FIG. 2) through each throttle body 88 for controlling the rate of air flow therethrough.

Each throttle valve 90 is preferably actuated by the operator of the watercraft 20 by a throttle control 41 positioned on the steering handle 40. The throttle valves 90 are each mounted to a single control rod or shaft 92. A pulley 94 is connected to an end of the shaft 92 which faces the front end of the watercraft 20. Preferably, a cable (not shown) is arranged to move the pulley from the throttle control 41 mounted at the steering handle 40.

The intake manifold 96 extends between the throttle body 88 and the engine 22. The intake manifold 96 defines a passage therethrough corresponding to the passage 89 through the throttle body 88 and an intake port 104 provided in the engine 22 leading to the crankcase 76.

The intake manifold 96 corresponding to each throttle body 88 is connected to its respective throttle body 88 with a coupling 98, securing the throttle body 88 at a lower end. Preferably, a brace 100 extends between the main body of the engine 22 and each throttle body 88 at its upper end for bracing the throttle body 88.

The crankcase chamber 76 is divided into two compartments, a compartment corresponding to each cylinder 70. A reed-type valve 102 is positioned in each intake port 104. The reed valve 104 is arranged to permit the flow of air into the crankcase 76 but prevent the flow of air out of the crankcase 76 in the direction of the manifold 96.

As is well known in the two-cycle engine art, the engine is arranged so that when the piston 72 moves upwardly, air is drawn through the intake system, including the reed valve 104 into the crankcase chamber 70. As the piston 72 moves downwardly, the air is compressed and eventually flows through one or more scavenge passages 108 leading into the portion of the cylinder 70 above the piston 72.

Preferably, fuel is provided to each cylinder 72 for combustion with the air. The fuel system preferably includes a fuel supply comprising fuel positioned in a fuel tank 110 (see FIG. 1). The fuel tank 110 is preferably positioned in front of the engine 22 towards the front end of the watercraft 20. The tank 110 is supported on a number of mounts 112 above the lower surface 46 of the hull. A fuel fill inlet 114 is provided in the top portion 27 of the hull 28. A hose or pipe 116 leads from the inlet 114 to the tank 110.

Referring to FIG. 3, a fuel pump 118 or other delivery mechanism is provided for delivering fuel -from the tank 110 through a delivery line 120 to a fuel rail 122. The fuel pump 118 preferably delivers fuel at high pressure to the fuel rail 122. A fuel injector 124 corresponding to each cylinder 70 receives fuel from the fuel rail 122.

Referring to FIG. 2, a connecting part 126 extends between the fuel rail 122 and the fuel injector 124 through which fuel is delivered. A protective cover 128 is provided at each coupling of the fuel rail 122 and fuel injector 124 for protecting them and the connecting part 126 from exposure to water and other harmful elements. The cover 128 may comprise a rubber sleeve or the like.

Each fuel injector 124 is arranged to inject fuel into the air passing through the passage 89 through the throttle body 88. Fuel which is supplied to the fuel rail under pressure but not delivered by the injectors 124 is preferably routed back to the fuel tank 110 through a fuel return line 130.

The fuel injectors 124 are preferably of the solenoid-operated type, having a control wire 132 leading thereto and through which an electric control signal is transmitted for opening and closing a valve 124 associated with the injector 124. The wire 132 is preferably also covered by the cover element 128 for protecting it from damage.

The timing of the control signal to each injector 124 is preferably provided by an electronic control unit (ECU) 134. The ECU 134 receives data such as throttle valve position sensor 150 (described below) for use in controlling the timing of the fuel injection with each fuel injector 124.

An ignition system is provided for igniting the fuel and air charge which is supplied to the cylinder 70. The ignition system may be arranged in a variety of manners known to those of skill in the art. In general, the ignition system includes a power source, such as a battery or generator (not shown) and a spark plug 136 associated with each cylinder 70. The ECU 134 is preferably arranged to selectively control the firing of each spark plug 136 in a timed manner for initiating combustion in each cylinder 70.

Exhaust generated by the engine 22 as a result of the combustion process is routed from the engine to a point external to the watercraft 20 by an exhaust system which includes an upper exhaust pipe 138. Referring to FIG. 2, exhaust from each cylinder 70 is preferably expelled therefrom to the upper exhaust pipe 138 through an exhaust passage 140 extending through the cylinder head 68. An exhaust timing valve (not shown) may be provided in the passage 118 for controlling the timing of the opening and closing of the passage 140, as is well known to those of skill in the art.

As best illustrated in FIG. 1, the upper exhaust pipe 138 extends towards a front end of the engine 22, before looping back to an expanded portion which extends along a top of the engine towards the rear of the watercraft 20. A catalyst 142 is preferably positioned in this expanded portion of the upper exhaust pipe 138.

The upper exhaust pipe 138 leads to a water lock 144, as well known in the art. A lower exhaust pipe 146 extends from the water lock 144 to a discharge point, preferably in the water positioned in the propulsion chamber 43. The water lock 144 is preferably arranged to prevent the flow of water through the lower exhaust pipe 146 back towards the engine 22.

Preferably, the engine 22 is provided with a throttle valve position sensor 150, as illustrated in FIG. 3. The sensor 150 is arranged to provide throttle valve opening position data to an engine control, such as the ECU 134. This position data can be used to control the volume of fuel supplied to the engine 22 and the like. The sensor 150 may be of a variety of types known in the art. In the embodiment illustrated, the sensor 150 is arranged to provide throttle position data based upon a rotational position or angle of the throttle control shaft 92 associated with the valves 90.

In the first embodiment, the sensor 150 is preferably mounted in an arrangement which protects it from water which enters the engine compartment 42 with air through the intake duct 80. As illustrated, the sensor 150 is mounted to a rear end 152 of the shaft 92 to which the throttle valves 90 are mounted. In this arrangement, both throttle bodies 88 and intake manifolds 96 are positioned between the sensor 150 and the outlet 84 of the intake duct 80. Thus, the sensor 150 is shielded from water which passes through the duct 80, reducing the possibility of the sensor 150 malfunctioning and corroding, reducing its useful life.

An alternate sensor position in accordance with this embodiment is illustrated in FIG. 3. In this position, the sensor 150' is mounted to a connecting part 154 of the shaft 92 which extends between the two throttle bodies 88. In this position, the sensor 150' is still shielded from water entering the duct 80 by the forward-most throttle body 88 and intake manifold 96.

Figure 4:
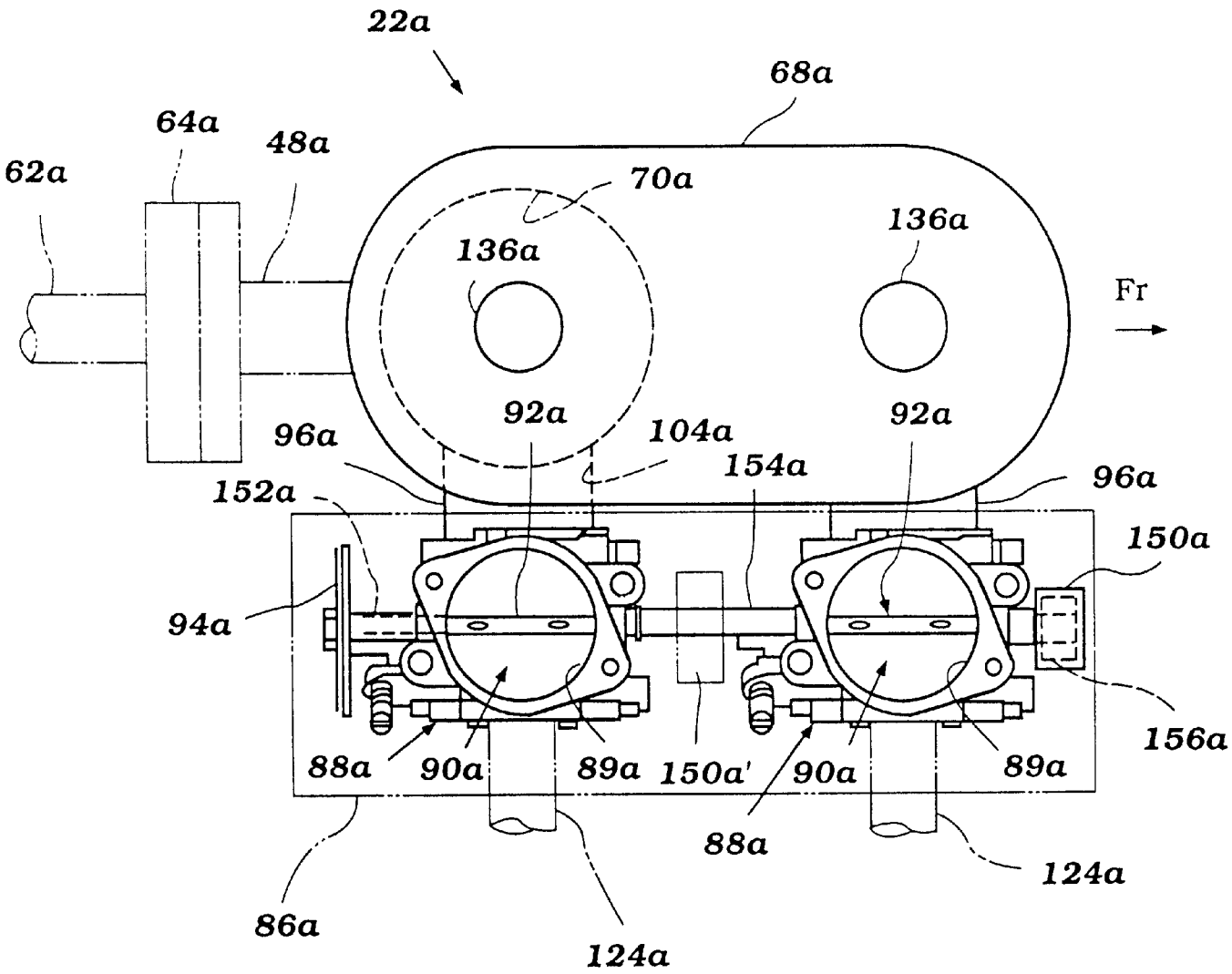
FIG. 4 is a top view of a portion of the engine similar to that illustrated in FIG. 1, with an intake silencer illustrated in phantom and an intake duct of the watercraft also illustrated in phantom, and illustrating the throttle position sensor mounted in accordance with a second embodiment of the invention.

A second embodiment of the present invention is illustrated in FIG. 4. In the description and illustration of this embodiment, like or similar parts have been given like reference numerals to those used in the description and illustration of the first embodiment, except that an "a" designator has been added to all the reference numbers used herein.

In this embodiment, the sensor 150*a* is mounted so as to protect it from water which may be sprayed by the crankshaft 48*a,* coupling 64*a* and/or impeller shaft 62*a*. As is well known, water which enters the watercraft will settle to the bottom surface. This water is typically pumped from the hull by a bilge pump (not shown). If the water level becomes too high, the rotating crankshaft 48*a,* coupling 64*a* and/or impeller shaft 62*a* will throw the water about the engine compartment.

To shield the throttle position sensor 150*a* from this water, the sensor 150*a* is preferably positioned at a front end 156*a* of the throttle valve control shaft 92*a*. In this position, both throttle bodies 88*a* and intake manifolds 96*a* are positioned between the rotating crankshaft 48*a,* coupling 64*a* and impeller shaft 62*a* and the sensor 150*a*. In an alternate position, the sensor 150*a'* may be positioned between along the part 154*a* of the shaft 92*a* extending between the throttle bodies 88*a,* such that the rear-most throttle body 88*a* and intake manifold 96*a* shields the sensor 150*a'*.

As illustrated, when the sensor 150*a* is positioned at the front end 156*a* of the shaft 92*a,* the pulley 94*a* is preferably positioned at the rear end 152*a*.

Figure 5:
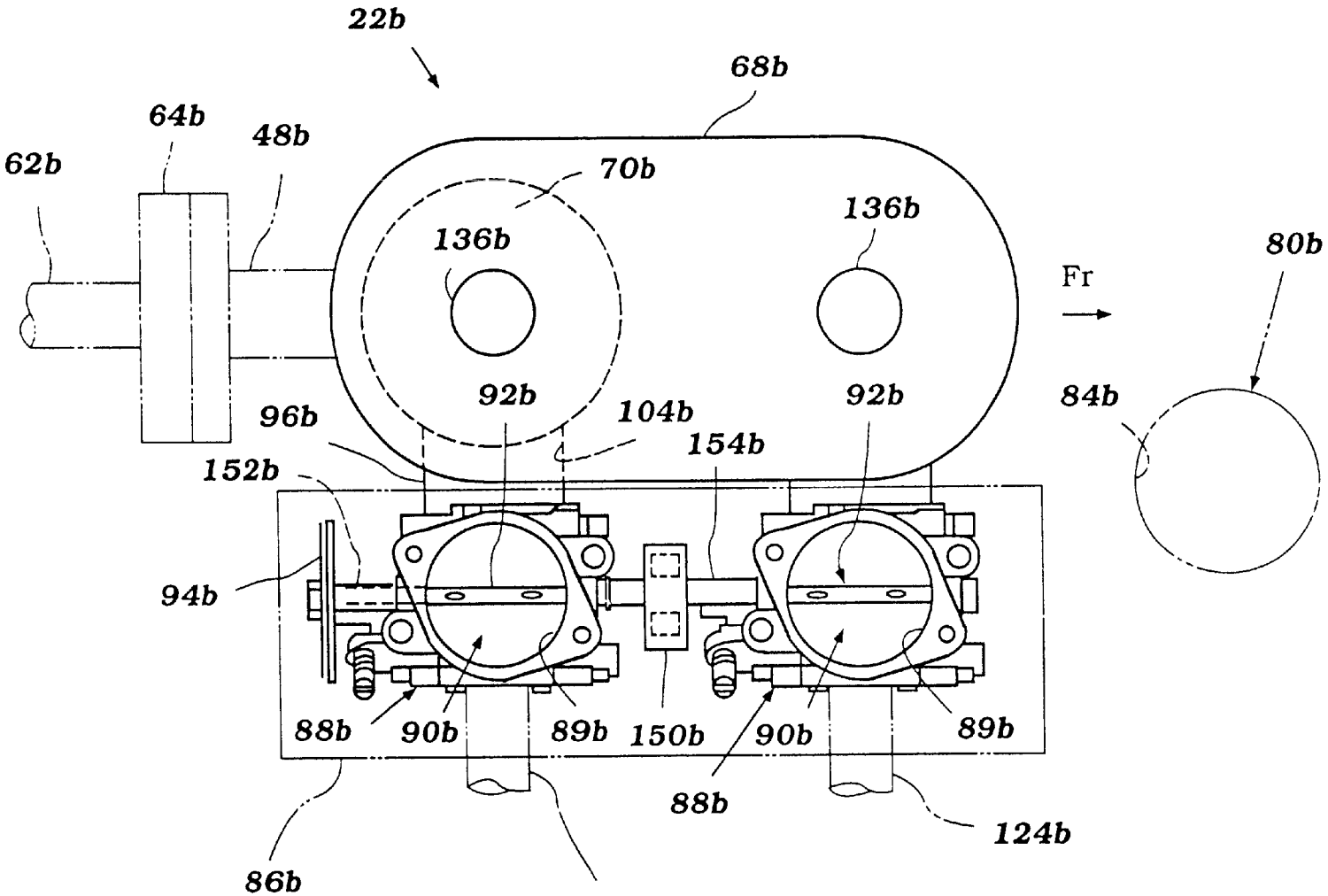
FIG. 5 is a top view of a portion of the engine similar to that illustrated in FIG. 1, with an intake silencer illustrated in phantom and an intake duct of the watercraft also illustrated in phantom, and illustrating the throttle position sensor mounted in accordance with a third embodiment of the invention.

A third embodiment of the present invention is illustrated in FIG. 5. In the description and illustration of this embodiment, like or similar parts have been given like reference numerals to those used in the description and illustration of the previous embodiments, except that a "b" designator has been added to all the reference numbers used herein.

In this embodiment, water from both an intake duct 80*b* positioned in front of the engine 22*b* and the crankshaft 48*b*/coupling64*b*/impeller shaft 62*b* extending from the rear end of the engine 22*b* is a concern. In this instance, the throttle position sensor 150*b* is preferably positioned on the connecting part 154*b* of the control shaft 92*b*. In this position, the sensor 150*b* is shielded from water from the intake duct 80*b* by the forward-most throttle body 88*b* and intake manifold 96*b,* and from water from the crankshaft 48*b*/coupling 64*b*/impeller shaft 62*b* by the rear-most throttle body 88*b* and intake pipe 90*b*.

Figure 6:
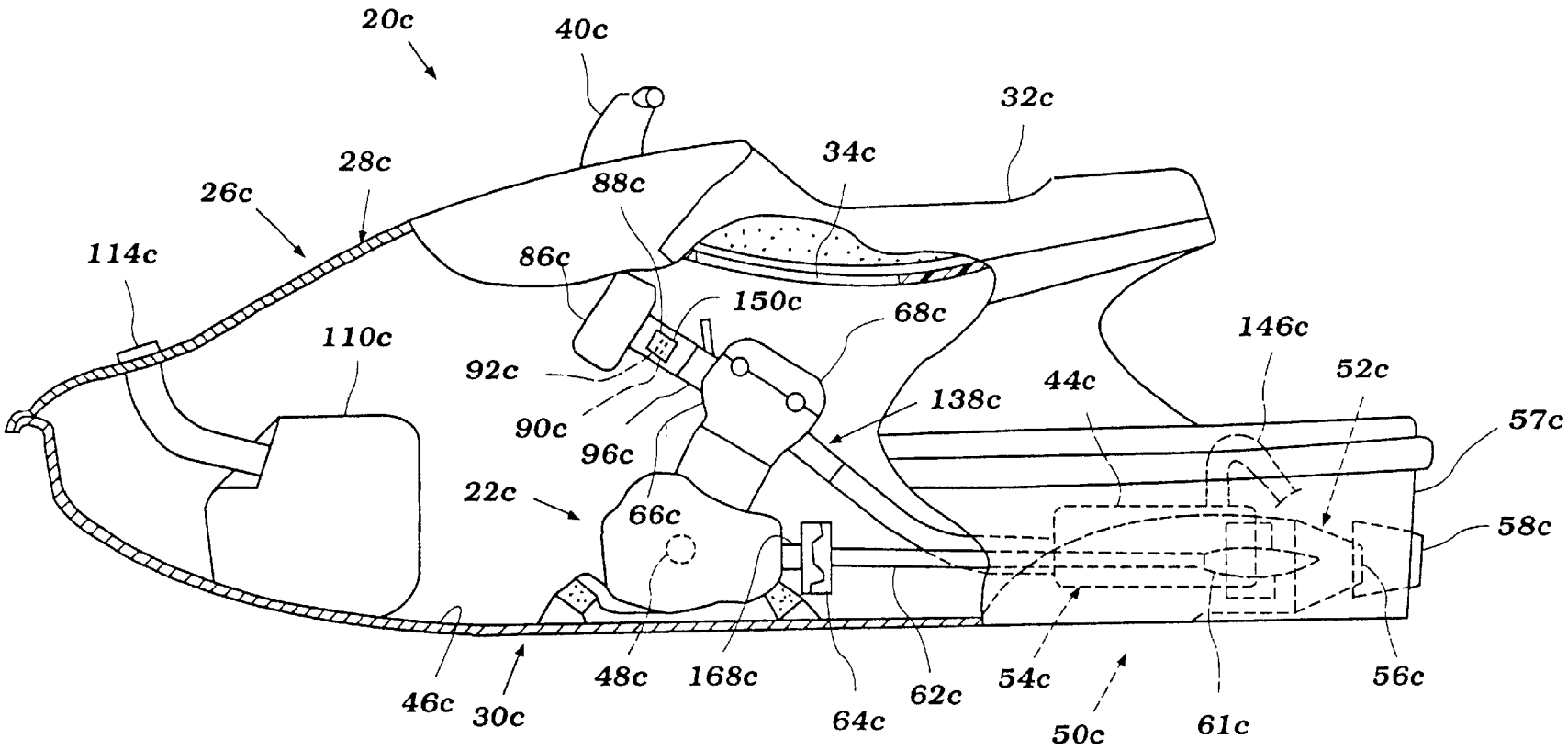
FIG. 6 is a side view of a watercraft powered by an engine having a throttle position sensor mounted in accordance with a fourth embodiment of the present invention, with a portion of the watercraft cut-away to expose the engine therein.
Figure 7:
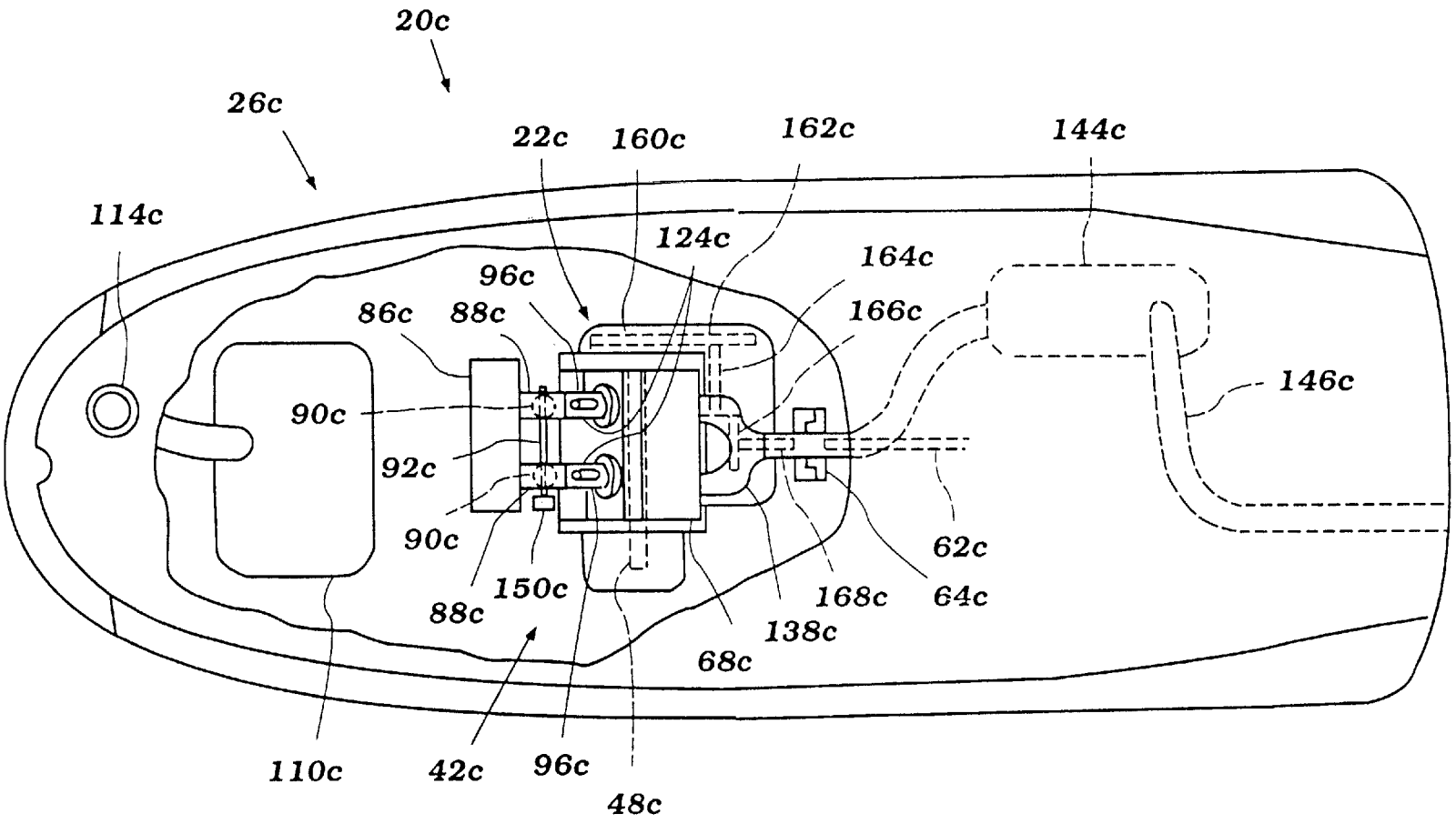
FIG. 7 is a top view of the watercraft illustrated in FIG. 6, partially cut-away to expose the engine therein.

A fourth embodiment of the present invention is illustrated in FIGS. 6 and 7. In the description and illustration of this embodiment, like or similar parts have been given like reference numerals to those used in the description and illustration of the previous embodiments, except that a "c" designator has been added to all the reference numbers used herein.

In this embodiment, the watercraft 20*c* is generally the same as that illustrated in FIG. 1. The engine 22*c,* however, is mounted within the engine compartment 42*c* so that its crankshaft 48*c* extends transversely to the longitudinal axis through the watercraft 20*c* from front to rear. In this arrangement, a drive gear 160*c* is positioned at one end of the crankshaft 48*c*. This gear 160*c* drives a driven gear 162*c* on an offset shaft 164*c*. A bevel gear 166*c* is positioned at the end of the offset shaft 164*c* opposite the driven gear 162*c,* the bevel gear 166*c* arranged to drive an output shaft 168*c*. The output shaft 168*c* extends to the coupling 64*c* and is coupled therewith to the impeller shaft 62*c*.

In this arrangement, the drive and driven gears 160*c,*162*c* are positioned at one side of the engine 22*c*.

The intake system of the engine 22*c* extends generally from a front surface thereof towards the front end of the watercraft 20*c*. The exhaust system extends generally from the rear end of the engine 22*c* opposite the intake system, as best illustrated in FIG. 6. In this arrangement, the throttle bodies 88*c* and connected intake manifolds 96*c* are arranged side-by-side (instead of front to rear, as in the embodiment illustrated in FIG. 1).

In this embodiment the throttle position sensor 150*c* is preferably mounted at an end of the control shaft 92*c* which is opposite the side of the engine 22*c* at which is positioned the drive and driven gear 160*c,*162*c* arrangement of the crankshaft 48*c* to output shaft 168*c* coupling. In this embodiment, the throttle body 88*c* and engine 22*c* itself protect the sensor 150*c*. Additionally, as shown in FIGS. 6 and 7, the sensor 150*c* is positioned between a longitudinal axis of the hull (not shown) and a portion of the upper deck.

Figure 8:
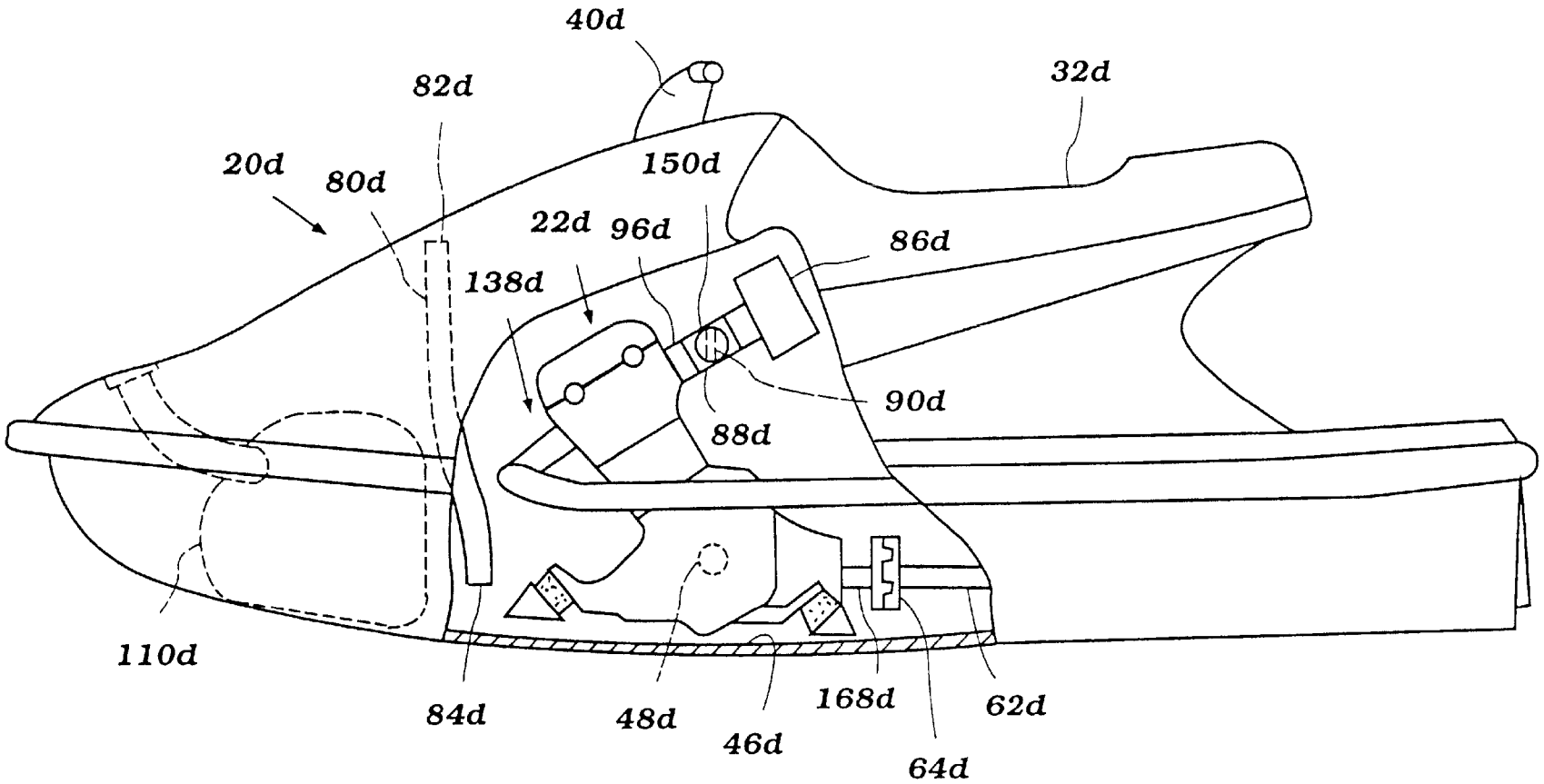
FIG. 8 is side view of a watercraft powered by an engine having a throttle position sensor mounted in accordance with a fifth embodiment of the present invention, with a portion of the watercraft cut-away to expose the engine therein.
Figure 9:
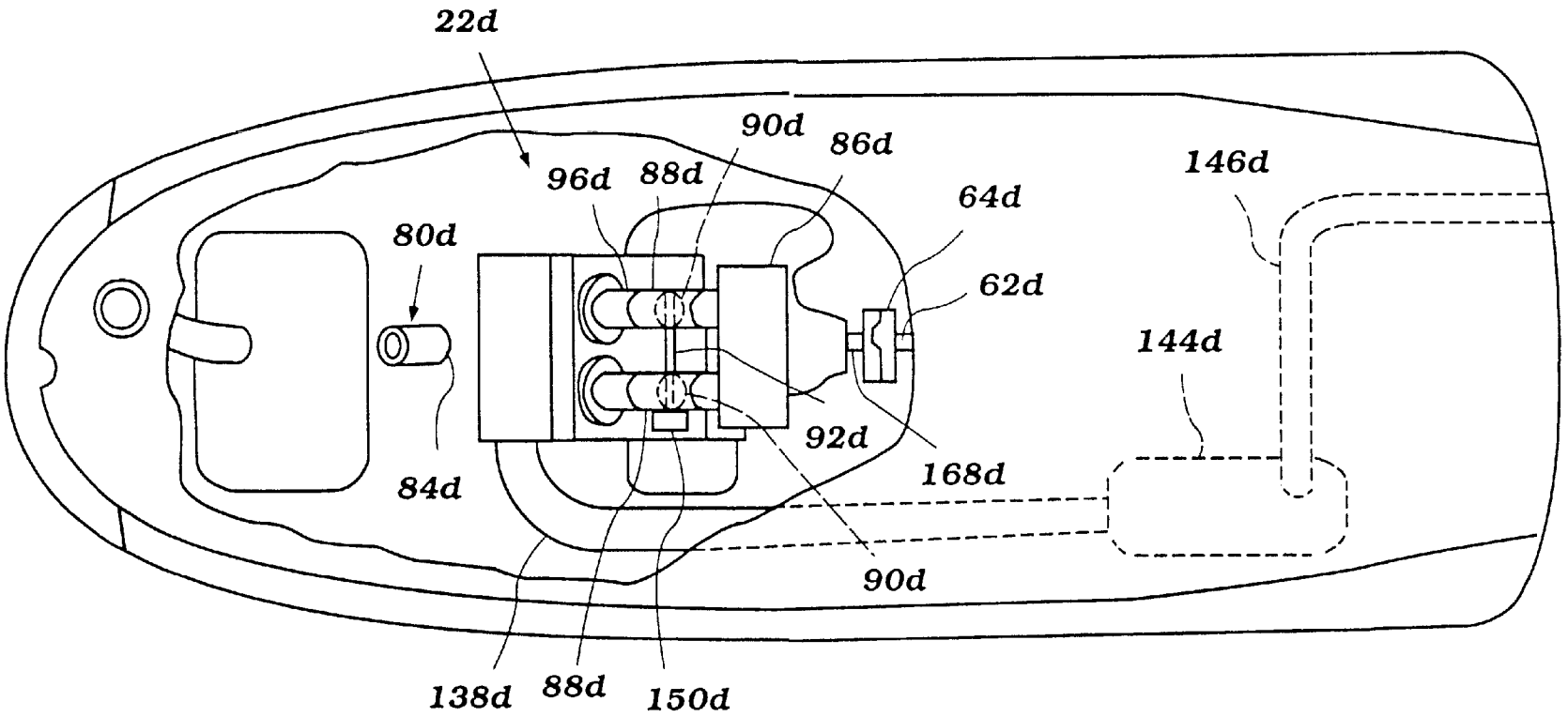
FIG. 9 is a top view of the watercraft illustrated in FIG. 8, partially cut-away to expose the engine therein.

A fifth embodiment of the present invention is illustrated in FIGS. 8 and 9. In the description and illustration of this embodiment, like or similar parts have been given like reference numerals to those used in the description and illustration of the previous embodiments, except that a "d" designator has been added to all the reference numbers used herein.

In this embodiment, the engine 22*d* is generally arranged in the watercraft 20d similar to that of the previous embodiment illustrated in FIGS. 6 and 7, with a crankshaft 48*d* oriented transverse to the longitudinal axis of the watercraft 20*d* through its front and rear ends, and arranged to drive an output shaft 168*d* which drives an impeller shaft 62*a*.

In this embodiment, however, the engine 22 is arranged with its cylinders generally tilted in a forward direction, with the intake system extending from a rear surface thereof towards the rear of the watercraft 20*d*. The exhaust system is arranged so that the exhaust pipe 138*d* extends from a front surface of the engine 22*d* which faces towards the front end of the watercraft 20*d*. The exhaust pipe 138*d* extends from the engine 22*d* first in the forward direction, and then curves towards the rear of the watercraft 22*d,* extending to the water lock 144*d*.

In this embodiment, there is again provided an air duct 80*d* positioned in front of the engine 22*d* through which air is routed from outside the hull 26*d* into the engine compartment.

A throttle position sensor 150*d* is again provided for providing throttle valve position data. The sensor 150*d* is mounted to an end of the control shaft 92*d* which is opposite the side of the engine where the crankshaft 48*d* is arranged to drive the output shaft 168*d*. The sensor 150*d* is shielded from water which may enter the intake duct 80*d* by the engine 22*d* body itself. Additionally, similarly to the embodiment of FIGS. 6 and 7, the sensor 150*d* is positioned between a longitudinal axis (not shown) of the hull and a portion of the upper deck.

Figure 10:
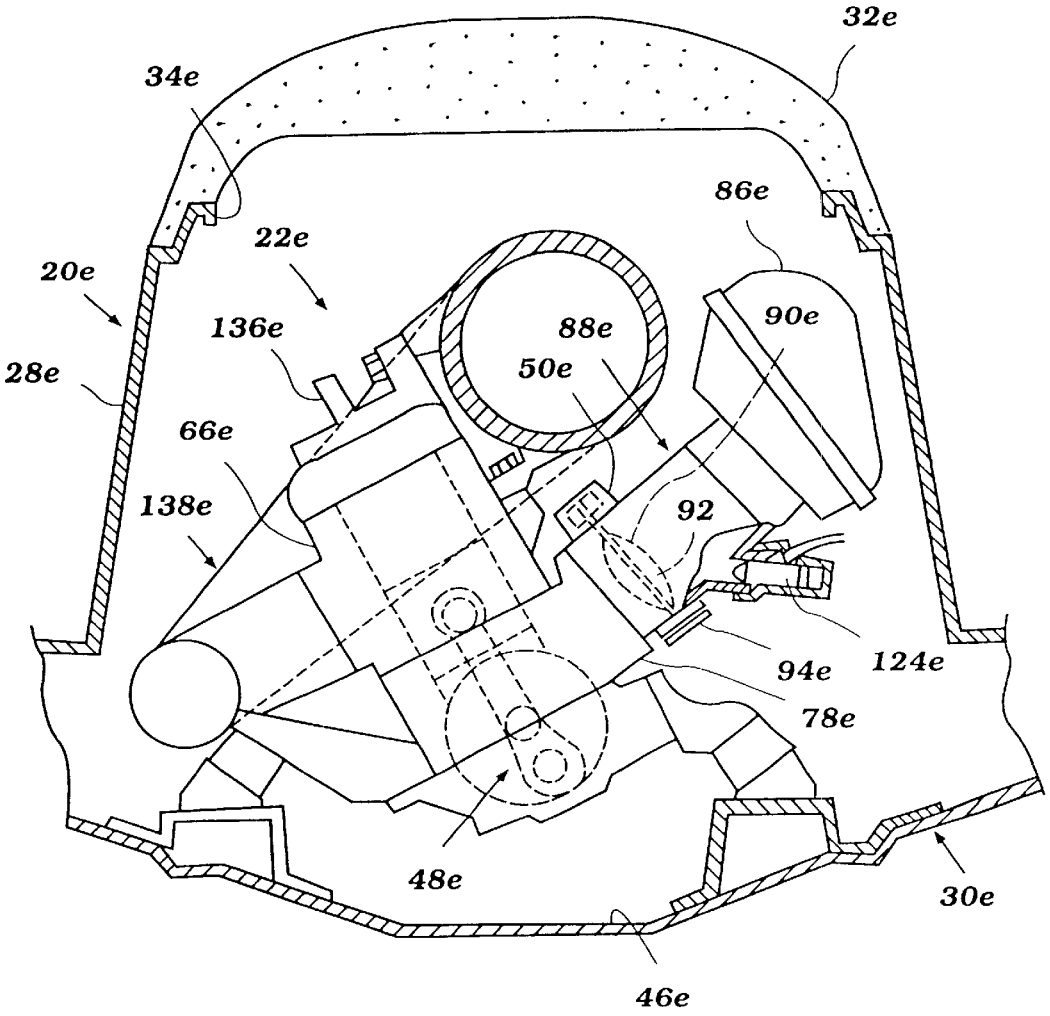
FIG. 10 is a cross-sectional end view of a watercraft powered by an engine having a throttle position sensor mounted in accordance with a sixth embodiment of the present invention.
Figure 11:
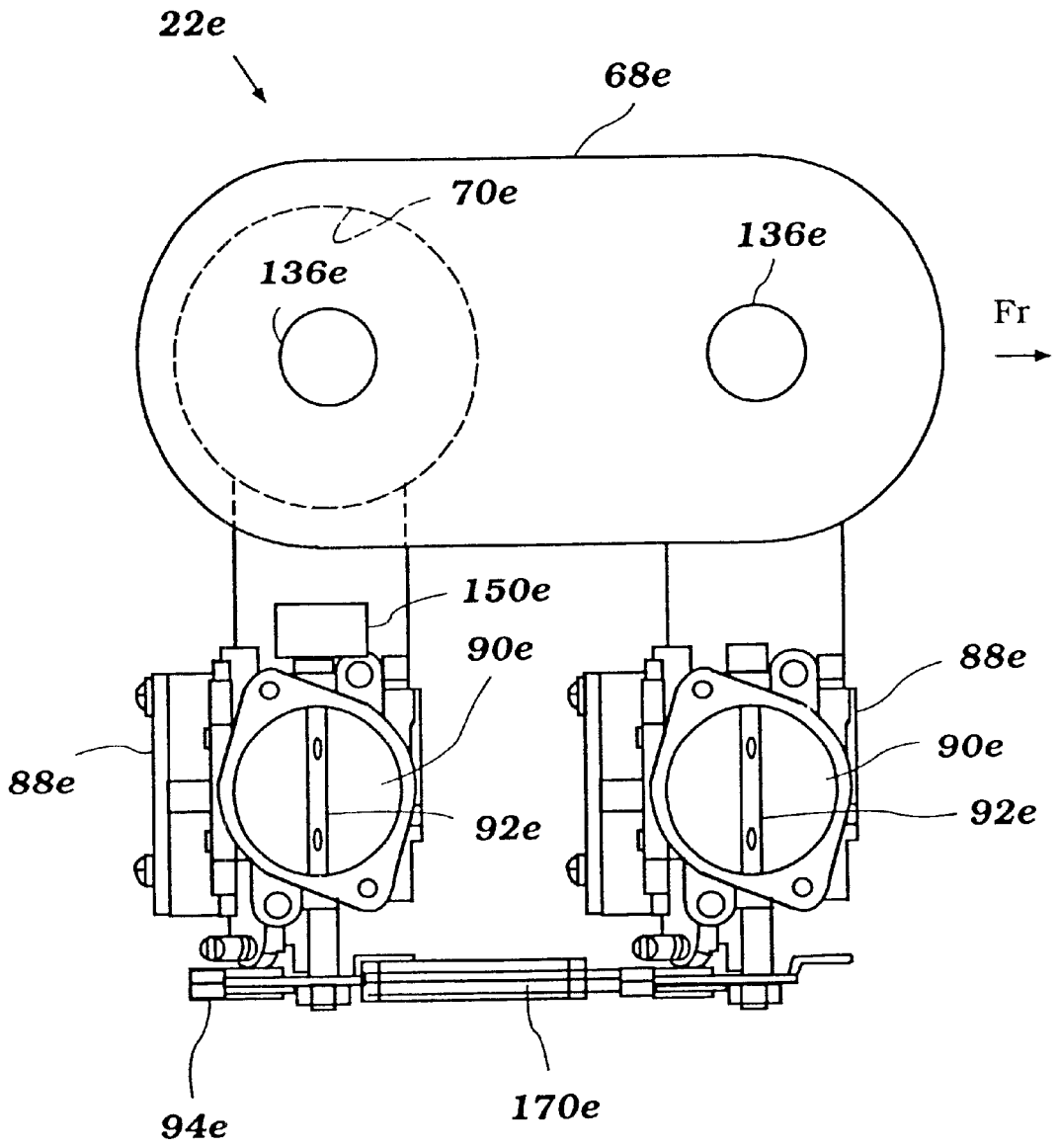
FIG. 11 is a top view of a portion of the engine having the throttle position sensor illustrated in FIG. 10 with an intake silencer of the engine removed.

A sixth embodiment of the present invention is illustrated in FIGS. 10 and 11. In the description and illustration of this embodiment, like or similar parts have been given like reference numerals to those used in the description and illustration of the previous embodiments, except that an "e" designator has been added to all the reference numbers used herein.

In this embodiment, the engine 22*e* is again arranged similar to that illustrated in FIG. 1, wherein the crankshaft 48*e* extends parallel to a longitudinal line through the front and rear ends of the watercraft 20*e*. The engine 22*e* is tilted, however, so that the cylinders 70*e* are offset to one side of a vertical plane. In this arrangement, the intake system extends from the side of the engine 22*e* which faces generally upwardly.

The intake pipe preferably comprises only the throttle body 88*e* directly connected to the engine 22*e*. Again, and as illustrated in FIG. 11, a throttle valve 90*e* is positioned in the passage through each throttle body 88*e* leading from the air intake or silencer 86*e*. The throttle bodies 88*e* are spaced in front-to-rear direction. Unlike the arrangement in FIG. 1 where both valves are operated by a control shaft which extends longitudinally, a control rod or shaft 92*e* is provided for each valve 90*e*. Each shaft 92*e* extends transversely to a longitudinal axis through the watercraft 20*e*.

The valves 90*e* are operated together by a linkage 170*e* which operates a pulley 94*e* positioned on an end of each control shaft 92*e*. The pulleys 94*e* are positioned on the end of the shafts 92*e* which are opposite the engine 22*e*.

Again, a throttle valve position sensor 150*e* provides throttle valve position data. In this embodiment, the sensor 150*e* is positioned at an end of one of the shafts 94*e* opposite the pulley 94*e*. In this manner, the sensor 150*e* is positioned between the throttle body 88*e* and the engine 22*e,* protecting it from the elements. For example, the sensor 150*e* will be protected from water which splashes about the engine compartment at the lower surface 46*e*.

Of course, the foregoing description is that of preferred embodiments of the invention, and various changes and modifications may be made without departing from the spirit and scope of the invention, as defined by the appended claims.

What is claimed is:

1. A watercraft having a propulsion device and a hull defining an engine compartment, an internal combustion engine positioned in said engine compartment and having an output shaft arranged to power said water propulsion device, an air intake duct having an outlet positioned within the engine compartment, said engine having at least one combustion chamber and an intake system through which air is routed to said combustion chamber, said intake system including an intake pipe extending from said engine, a throttle valve movably positioned in said intake pipe for controlling the rate of air flow therethrough, and a throttle valve position sensor positioned above the outlet of the intake duct.

2. The watercraft in accordance with claim 1, wherein the sensor is positioned so as to shield the sensor from a source of water comprising the intake duct.

3. The watercraft in accordance with claim 1, wherein the sensor is positioned so as to shield the sensor from a source of water comprising said output shaft extending from an end of said engine in contact with water filling a lower portion of said engine compartment.

4. The watercraft in accordance with claim 1, wherein said engine has a first combustion chamber and a second combustion chamber and a first intake pipe routing air to said first combustion chamber and a second intake pipe routing air to said second combustion chamber.

5. The watercraft in accordance with claim 4, wherein said first and second intake pipes are positioned in a front-to-rear direction along a length of said watercraft.

6. The watercraft in accordance with claim 5, wherein the sensor is positioned between said first and second intake pipes.

7. The watercraft in accordance with claim 5, wherein the sensor is mounted at a rear end of said intake pipes and said outlet is positioned forward of said intake pipes, so as to shield the sensor from a source of water comprising said air intake duct.

8. The watercraft in accordance with claim 4, wherein said first and second intake pipes are mounted in side-by-side relationship in a direction transverse to a length of said watercraft.

9. The watercraft in accordance with claim 1, wherein said throttle valve comprises a plate positioned in the intake pipe, said plate connected to a control shaft, wherein the sensor is mounted to an end of said shaft.

10. The watercraft in accordance with claim 1, wherein said intake pipe comprises a throttle body.

11. The watercraft in accordance with claim 1, further including a fuel injector which injects fuel into said pipe.

12. The watercraft in accordance with claim 11, wherein said fuel injector is connected to a fuel rail and a protective cover covers said fuel injector at said connection to said fuel rail.

13. A watercraft having a water propulsion device and a hull having a longitudinal axis therethrough, said hull defining an engine compartment, an internal combustion engine positioned in said engine compartment and having a crankshaft extending generally perpendicular to said axis, an output shaft extending from a rear end of said engine, said output shaft arranged to power said water propulsion device, said engine having at least one combustion chamber and an intake system through which air is routed to said combustion chamber, said intake system including an intake pipe extending from said engine, a throttle valve movably positioned in said intake pipe for controlling the rate of air flow therethrough, and a throttle valve position sensor positioned forward from a front surface of the engine so as to be shielded from a source of water comprising the output shaft in contact with water in the engine compartment.

14. The watercraft in accordance with claim 13, wherein the source of water comprises the output shaft extending from an end of the engine in contact with water filling a lower portion of the engine compartment.

15. The watercraft in accordance with claim 13, wherein the engine has a first combustion chamber and a second combustion chamber and a first intake pipe routing air to the first combustion chamber and a second intake pipe routing air to the second combustion chamber.

16. The watercraft in accordance with claim 15, wherein the first and second intake pipes are positioned side-by-side.

17. The watercraft in accordance with claim 13, wherein the throttle valve comprises a plate positioned in the intake pipe, the plate connected to a control shaft, and wherein the sensor is mounted to an end of the shaft.

18. The watercraft in accordance with claim 13, further including a fuel injector which injects fuel into the intake pipe.

19. The watercraft in accordance with claim 18, wherein the fuel injector is connected to a fuel rail and a protective cover covers the fuel injector at the connection to the fuel rail.

20. The watercraft in accordance with claim 1, wherein the throttle valve position sensor is positioned directly above the crankcase of the engine.

21. The watercraft in accordance with claim 20, wherein the throttle position sensor is arranged directly above the crankcase of the engine such that the throttle position sensor is shielded from water that may pool in a bottom of the engine compartment.

22. The watercraft in accordance with claim 20, wherein the engine comprises an engine body having at least one cylinder bore defining the at least one combustion chamber, the cylinder having a cylinder axis which is inclined with respect to a vertical axis.

23. The watercraft in accordance with claim 22, wherein the cylinder axis leans toward a front of the watercraft.

24. The watercraft in accordance with claim 22, wherein the cylinder axis leans towards a rear of the watercraft.

25. A watercraft having a water propulsion device and a hull defining an engine compartment, an internal combustion engine positioned in the engine compartment and having an output shaft arranged to power the water propulsion device, the engine having an engine body defining at least one combustion chamber, an intake system through which air is routed to the combustion chamber, the intake system including an intake pipe extending from the engine body, a throttle valve movably positioned in the intake pipe for controlling the rate of air flow therethrough, and a throttle valve position sensor positioned between the engine body and the intake pipe.

26. The watercraft in accordance with claim 25, wherein at least a portion of the intake pipe extends upwardly from the engine body, the throttle position sensor being positioned above an upper surface of the upwardly extending portion of the intake pipe.

27. The watercraft in accordance claim 25 additionally comprising an exhaust system configured to guide combustion gases from the at least one combustion chamber to the atmosphere, at least a portion of the exhaust system extending above the throttle position sensor.

28. The watercraft in accordance with claim 27, wherein the exhaust system includes an expansion chamber positioned above the throttle position sensor.

29. The watercraft in accordance with claim 25, wherein the throttle valve comprises a shaft extending through the intake pipe and a valve member mounted to the shaft, the shaft extending generally perpendicularly to the output shaft.

30. The watercraft in accordance with claim 1, wherein the hull includes a lower portion and an upper deck portion, the throttle valve position sensor being positioned between a longitudinal axis of the hull and a portion of the upper deck portion so as to shield the throttle position sensor from splashing water within the engine compartment.

31. The watercraft in accordance with claim 30,wherein the lower portion and the upper deck portion of the hull cooperate to form the engine compartment.

32. The watercraft in accordance with claim 30 additionally comprising a crankcase connected to the engine, at least a portion of the crankshaft being rotatably journaled for rotation within the crankcase of the engine about a crankcase shaft axis, the crankshaft axis being arranged generally transverse to a longitudinal axis of the hull.

33. The watercraft in accordance with claim 1, wherein the throttle valve is connected to a throttle valve shaft, the throttle valve position sensor being positioned at a forward end of the throttle valve shaft.

34. The watercraft in accordance with claim 1, wherein the throttle valve is connected to a throttle valve shaft, the throttle valve position sensor being positioned at a rear end of the throttle valve shaft.

35. The watercraft in accordance with claim 1 additionally comprising an intake device through which air from the engine compartment is drawn into the intake pipe, the throttle valve position sensor being positioned below the intake device.

36. The watercraft in accordance with claim 35, wherein the intake device comprises a filtered intake silencer.

* * * * *